US009869445B2

(12) United States Patent
Baccarin et al.

(10) Patent No.: US 9,869,445 B2
(45) Date of Patent: Jan. 16, 2018

(54) AUTOMOTIVE LIGHT

(71) Applicant: AUTOMOTIVE LIGHTING ITALIA S.p.A., Venaria Reale (IT)

(72) Inventors: Davide Baccarin, Tolmezzo (IT); Stefano Di Gallo, Tolmezzo (IT); Ivan Favro, Tolmezzo (IT); Jean Pascal Herlin, Tolmezzo (IT); Fabio Leone, Tolmezzo (IT); Stefano Marchesin, Tolmezzo (IT); Nicola Schiccheri, Tolmezzo (IT)

(73) Assignee: Automotive Lighting Italia S.p.A., Venaria Reale (IT)

( * ) Notice: Subject to any disclaimer, the term of this patent is extended or adjusted under 35 U.S.C. 154(b) by 287 days.

(21) Appl. No.: 14/881,798

(22) Filed: Oct. 13, 2015

(65) Prior Publication Data

US 2016/0102835 A1 Apr. 14, 2016

(30) Foreign Application Priority Data

Oct. 13, 2014 (IT) ..... TV2014A0149

(51) Int. Cl.
*F21S 8/10* (2006.01)

(52) U.S. Cl.
CPC ..... *F21S 48/24* (2013.01); *F21S 48/217* (2013.01); *F21S 48/2212* (2013.01); *F21S 48/234* (2013.01); *F21S 48/236* (2013.01)

(58) Field of Classification Search
CPC ..... B60Q 1/26; F21S 48/217; F21S 48/2212; F21S 48/2225; F21W 2101/00; F21Y 2115/15; H01L 2251/5323; H01L 2251/5338; H01L 2251/5361;
(Continued)

(56) References Cited

U.S. PATENT DOCUMENTS 9,368,755 B2 * 6/2016 Kim ..... H01L 51/5275
2003/0156410 A1 8/2003 Ter-Hovhannisian
2009/0262545 A1 10/2009 Amelung et al.
(Continued)

FOREIGN PATENT DOCUMENTS

WO WO 2011/098430 8/2011
WO WO 2013/054220 4/2013

OTHER PUBLICATIONS

Italian Search Report and Written Opinion for Italian Application No. IT TV20140149 dated Jun. 9, 2015.

*Primary Examiner* — Hargobind S Sawhney
(74) *Attorney, Agent, or Firm* — McCarter & English, LLP

(57) ABSTRACT

An automotive light includes a rear body; a front lenticular half-shell which closes the mouth of the rear body and is provided with at least one transparent/semi-transparent portion; and at least one lighting assembly which emits light upon command and is located within the rear body to backlight the transparent/semi-transparent portion of the front lenticular half-shell; the lighting assembly being provided with a planar OLED light source which faces the inner surface of the front lenticular half-shell and includes at least one plate-like OLED which emits light in a distributed way from its front and rear faces; and a rear refracting member facing the rear face of the OLED that re-directs light that exits from the rear face of the OLED towards a transverse light passage in the OLED in a direction such that the light can traverse the OLED and exit from the front face of the OLED.

15 Claims, 3 Drawing Sheets

(58) Field of Classification Search
CPC ..... H01L 27/3225; H01L 51/5262; H01L 51/5275; Y02B 20/36
See application file for complete search history.

(56) References Cited

U.S. PATENT DOCUMENTS

| | | | | |
|---|---|---|---|---|
| 2010/0097809 | A1* | 4/2010 | Munro | F21V 5/04 362/308 |
| 2013/0114267 | A1 | 5/2013 | Ho et al. | |
| 2014/0254171 | A1* | 9/2014 | Greiner | F21V 7/0091 362/308 |

* cited by examiner

AUTOMOTIVE LIGHT

The present invention relates to an automotive light.

More in detail, the present invention regards a rear light for automobiles, use to which the following description will make explicit reference without this implying any loss of generality.

BACKGROUND OF THE INVENTION

As is known, the most recent rear lights for automobiles usually comprise: a rigid rear body, which is substantially basin-shaped and is structured so as to be stably recessed in a compartment purposely provided in the rear part of the vehicle body; a front lenticular half-shell, which is arranged to close the mouth of the rear body so as to surface on the outside of the vehicle body and is provided with a series of transparent or semi-transparent portions, usually of colours different from one another; and a set of lighting assemblies, which are placed within the body, each immediately underneath a respective transparent or semi-transparent portion of the front lenticular half-shell so as to be able to backlight said transparent or semi-transparent portion of the half-shell.

In the most up-to-date automotive lights, each lighting assembly is constituted by a series of LED diodes (acronym of Light-Emitting Diodes), which are placed alongside one another, on a supporting board which is provided with the supply and control circuits of the various LED diodes, and is arranged within the body so that the LED diodes face the transparent or semi-transparent portion of the front half-shell.

Unfortunately, LEDs are punctiform light sources therefore a large number of LED diodes is necessary to backlight homogeneously each transparent or semi-transparent portion of the half-shell.

The distribution of the LED diodes, in fact, must be such as to produce a light beam able to meet the photometric specifications envisaged for the light signal associated to the transparent or semi-transparent portion of the half-shell, and that moreover has an intensity of the light as uniform as possible throughout the extension of the transparent or semi-transparent portion so as to satisfy the aesthetic requirements of manufacturers of automobiles, motorcycles, and the like.

Over the last few years, some automobile manufacturers have decided to equip the new models of motor vehicles with rear lights that are able to produce, on the front half-shell thereof, light patterns and/or light signals with particularly elaborate light effects, which are in both cases univocally referable to the individual automobile manufacturers.

In this way, even in conditions of poor or total absence of light, the new models of motor vehicles are readily distinguishable from other automobiles in circulation.

Unfortunately, the need to produce light patterns and/or light effects that are always different is limited by the emitting peculiarities of LED diodes (LED diodes are light sources of punctiform type) and by the dimensions of the supporting board.

SUMMARY OF THE INVENTION

Aim of the present invention is to provide a rear light for automobiles which is able to produce light patterns and/or light effects that are new and different from those produced by the rear lights currently available on the market.

In compliance with the above aims, according to the present invention there are provided automotive lights that include a substantially basin-shaped, rear body structured to be fixed on a vehicle body; a front lenticular half-shell which is arranged to close the mouth of the rear body and is provided with at least one transparent or semi-transparent portion; and at least one lighting assembly which emits light on command and is located within the rear body so as to backlight the transparent or semi-transparent portion of the front lenticular half-shell. The least one lighting assembly of the disclosed automotive lights generally comprises an OLED-type planar light source which is capable of emitting light from its own front face and is located within the rear body with the front face turned towards the inner surface of the front lenticular half-shell so as to direct the light produced towards the front lenticular half-shell. The automotive light is generally further characterized in that the OLED-type planar light source comprises: at least one plate-like OLED diode which is capable of emitting light in a distributed manner from its own front face and from its own rear face, and has at least one transverse light passageway structured for allowing the light to pass freely through the thickness of the same plate-like OLED diode, and a rear refracting member which is arranged facing the rear face of the OLED diode and is able to re-direct the light ($r_b$) coming out from the rear face of the OLED diode towards the transverse light passageway in a direction such that the light ($r_b$) can pass though the OLED diode and then come out from the front face of the OLED diode.

Additional features, functions and benefits of the disclosed automotive lights will be apparent from the detailed description which follows, particularly when read in conjunction with the appended figures.

BRIEF DESCRIPTION OF THE DRAWINGS

The present invention will now be described with reference to the annexed drawings, which illustrate a non-limiting example of embodiment thereof and in which.

DETAILED DESCRIPTION OF THE INVENTION

Figure 1:
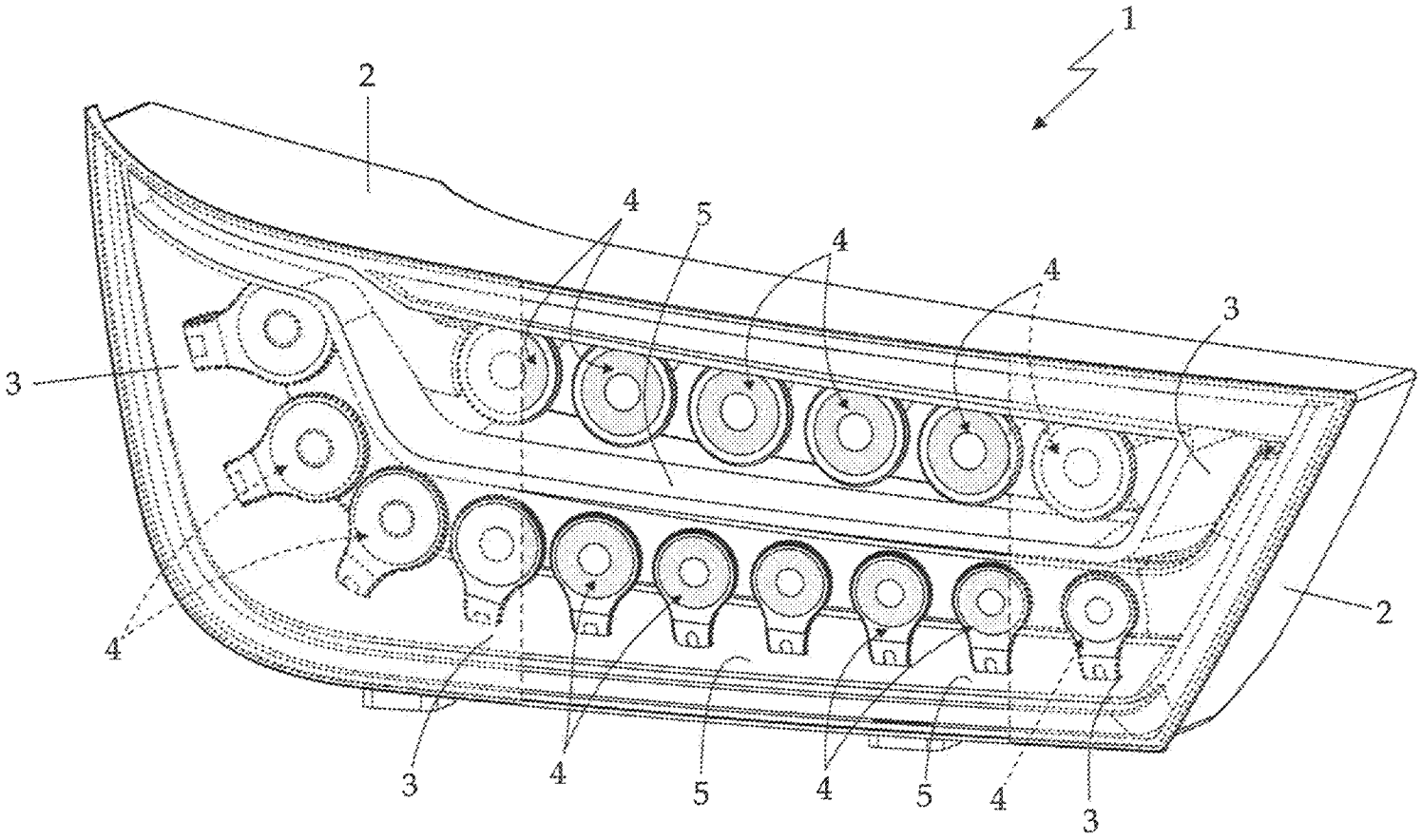
FIG. 1 is a perspective view of a rear light for automobiles realized according to the teachings of the present invention, with parts in section and parts removed for clarity.
Figure 2:
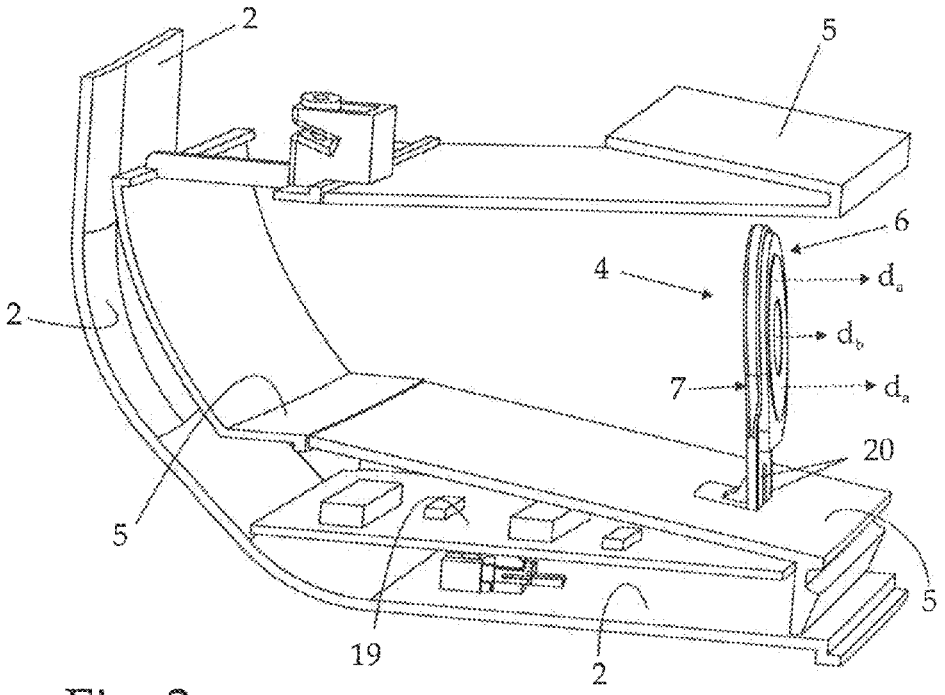
FIG. 2 is a perspective view of a portion of the automotive light shown in FIG. 1.

With reference to FIGS. 1 and 2, reference number 1 designates as a whole an automotive light particularly suitable for being fixed on the preferably rear part of the vehicle body of an automobile, van, lorry, motorcycle, or the like, i.e., an automotive rear light.

More in detail, the automotive light 1 is preferably, but not necessarily, structured for being recessed into the rear part of the vehicle body of an automobile, motorcycle, or similar vehicle, and basically comprises:

- a rear body 2 preferably made of plastic material, which is substantially basin-shaped and is preferably structured for being stably recessed into a compartment purposely provided in the rear part of the vehicle body (not shown);

a front lenticular half-shell 3 preferably made of plastic material, which is arranged to close the mouth of the rear body 2, preferably, but not necessarily, so as to surface at the same time on the outside of the vehicle body (not shown), and is provided with one or more transparent or semi-transparent portions, which may even be coloured; and one or more lighting assemblies 4, each of which emits light on command and is located within the rear body 2 in a position such as to be able to backlight a corresponding transparent or semi-transparent portion of the front lenticular half-shell 3.

More in detail, in the example shown, the front lenticular half-shell 3 is preferably provided with two distinct transparent or semi-transparent portions, optionally also of colours different from one another; and the automotive light 1 is preferably provided with two series of lighting assemblies 4 which are structured to emit light when electricity powered and are located within the rear body 2 so as to be able to separately backlight the two transparent or semi-transparent portions of the front lenticular half-shell 3.

In other words, the automotive light 1 is preferably provided with a first set of lighting assemblies 4, which are located within the rear body 2 in a position such as to be able to backlight exclusively the first transparent or semi-transparent portion of the front half-shell 3; and with a second set of lighting assemblies 4, which are located within the rear body 2 in a position such as to be able to backlight exclusively the second transparent or semi-transparent portion of the front half-shell 3.

Each lighting assembly 4 is therefore located underneath a corresponding sector of the first or second transparent or semi-transparent portion of the half-shell 3 so as to be able to backlight the same sector of the front lenticular half-shell 3.

In the example shown, in particular, the rear body 2 is preferably made of opaque plastic material, preferably via an injection-moulding process. The front lenticular half-shell 3 is, instead, preferably made of transparent or semi-transparent plastic material, such as for example transparent or semi-transparent polycarbonate or polymethylmethacrylate (traditionally referred to as Plexiglas), also in this case preferably via an injection-moulding process.

Figure 3:
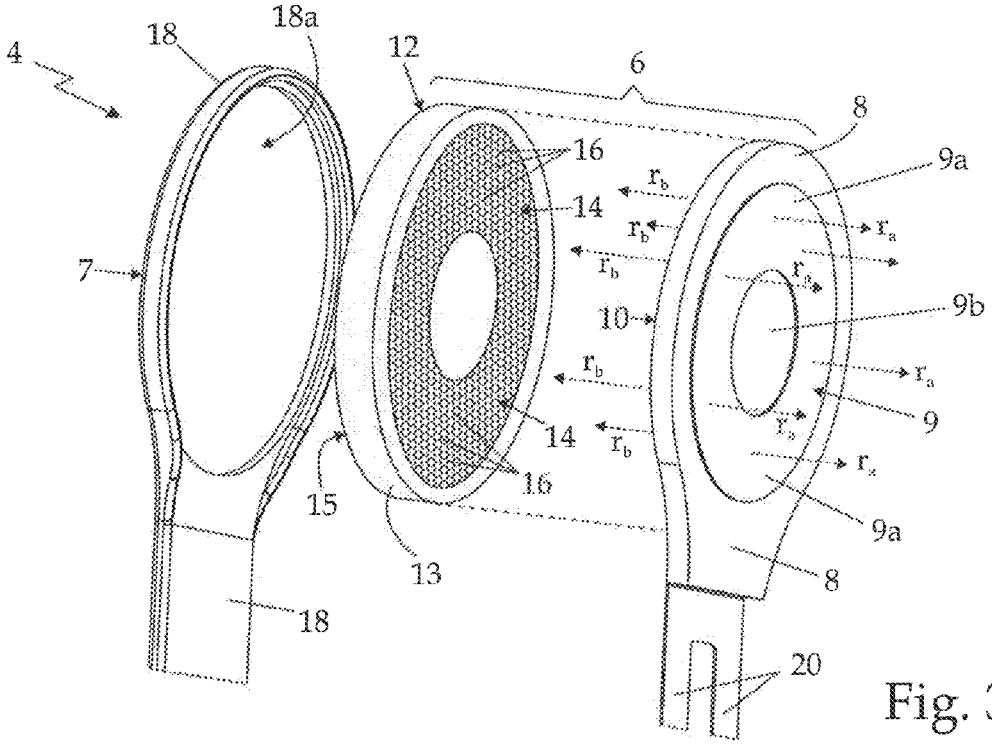
FIG. 3 is an exploded perspective view of a lighting assembly of the automotive light shown in FIGS. 1 and 2, with parts removed for clarity.

With reference to FIGS. 1, 2 and 3, the automotive light 1 preferably also comprises a covering mask 5 made of opaque material, which is located inside the rear body 2, underneath the front lenticular half-shell 3, and is structured to support and also hide from view part of the lighting assemblies 4.

Likewise the rear body 2, also the covering mask 5 is preferably made of opaque plastic material, preferably via an injection-moulding process.

Figure 4:
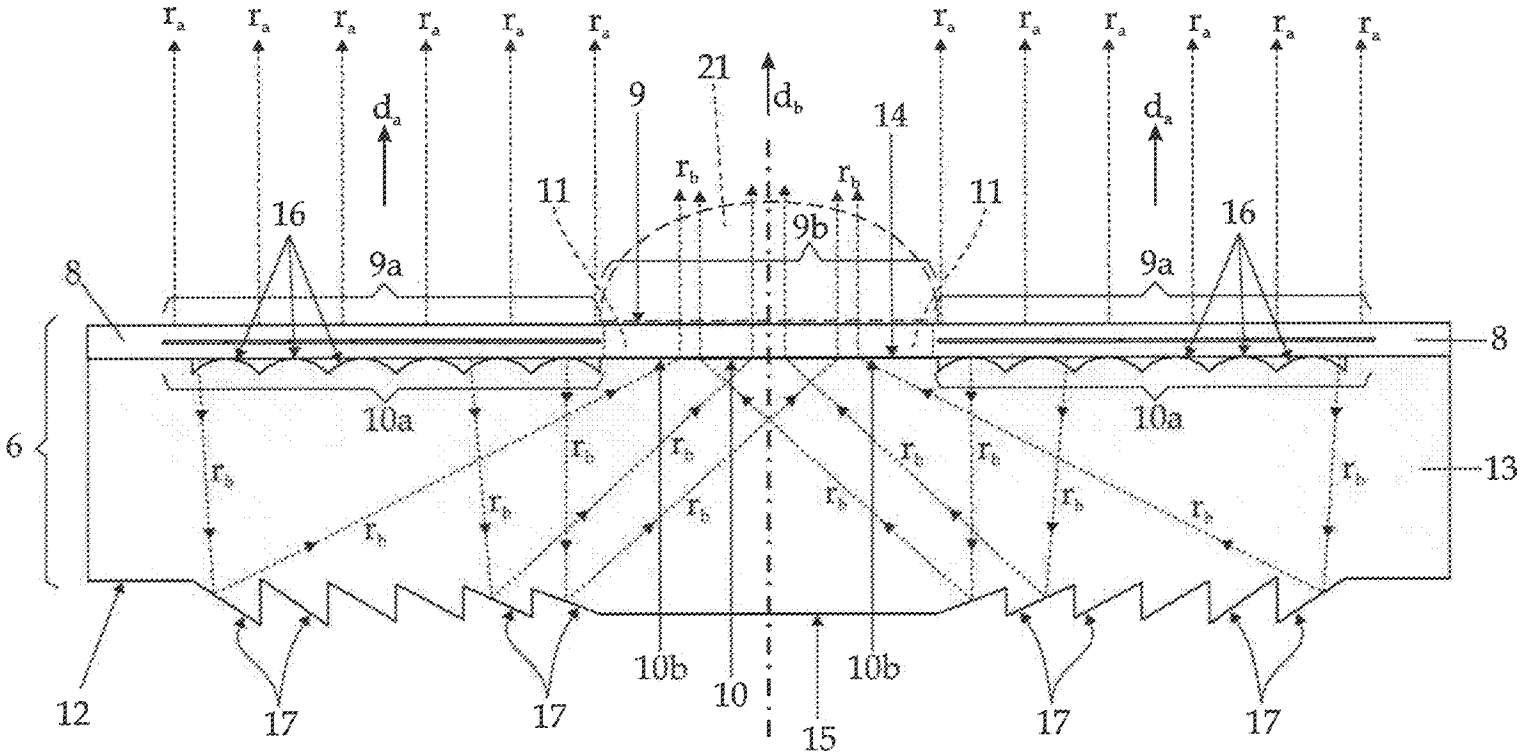
FIG. 4 is a cross-sectional view of a part of the lighting assembly shown in FIGS. 2 and 3.

With reference to FIGS. 2, 3 and 4, at least one and preferably all lighting assemblies 4 in turn comprise: an OLED-type (acronym of Organic Light-Emitting Diode) planar light source 6, which is able to emit light in a distributed way from its own front face, and is located underneath the front lenticular half-shell 3 with the front face turned towards the inner surface of the front half-shell 3 so as to direct the light coming out from the front face towards the front lenticular half-shell 3; and preferably also a rear supporting structure 7, which is located/fixed within the body 2, underneath the planar light source 6, and is configured to receive and support the planar light source 6, i.e., to keep it in place underneath the front lenticular half-shell 3.

With reference to FIGS. 2, 3 and 4, the planar light source 6 in turn comprises at least one plate-like OLED diode 8 (acronym of Organic Light-Emitting Diode), which is able to emit light in a distributed way from its own front face 9 and from its own rear face 10 and is located on the rear supporting structure 7 with its own front face 9 turned towards the inner surface of the front lenticular half-shell 3.

The body of the plate-like OLED diode 8 is moreover provided with at least one transparent sector 11 that extends from the front face 9 to the rear face 10 so as to allow the light to pass freely through the entire thickness of the plate-like OLED diode 8, therefore the front face 9 and the rear face 10 of the plate-like OLED diode 8 are both provided with one or more photo-emitting portions 9*a* and 10*a* aligned with one another in pairs and with one or more photo-inactive transparent portions 9*b* and 10*b* aligned with one another in pairs and contiguous with the photo-emitting portion or portions 9*a* and 10*a*.

The photo-emitting portions 9*a* and 10*a* are able to emit light towards the outside of the plate-like OLED diode 8, whereas the photo-inactive transparent portions 9*b* and 10*b* are permeable to light and are unable to emit light of their own.

More in detail, the transparent sector or sectors 11 can be located both within the external perimeter of the OLED diode 8 or substantially tangent to the external perimeter of the OLED diode 8.

The photo-emitting portion or portions 9*a* of the front face 9 of the OLED diode 8 are able to emit light rays $r_a$ towards the outside of the OLED diode 8 in a predetermined direction $d_a$ which is preferably locally substantially perpendicular to the surface of the front face 9.

Similarly, the photo-emitting portion or portions 10*a* of the rear face 10 of the OLED diode 8 are able to emit light rays $r_b$ towards the outside of the OLED diode 8 in a predetermined direction which is preferably locally substantially perpendicular to the surface of the rear face 10.

The photo-inactive transparent portions 9*b* and 10*b* of the plate-like OLED diode 8 are instead located at the two ends of the transparent sector 11.

With reference to FIGS. 3 and 4, the planar light source 6 additionally comprises a rear refracting member 12, which is arranged directly facing the rear face 10 of the OLED diode 8, preferably substantially throughout the extension of the same rear face 10, and is able to re-direct the light coming out from the rear face 10 towards the transparent sector 11 in a direction such that said light can pass though the OLED and then come out from the front face.

More in detail, the rear refracting member 12 is preferably arranged in abutment/resting on the rear face 10 of the plate-like OLED diode 8, preferably so as to cover the entire rear face 10, and is structured to divert the light rays $r_b$ coming out from the rear face 10 of the OLED diode 8, or rather from the photo-emitting portions 10*b* of the rear face 10, re-directing them towards the photo-inactive transparent portion or portions 10*b* of the rear face 10 with an angle of incidence and a direction that allow the light rays $r_b$ to pass through the OLED diode 8 and then freely come out from the front face 9 of the OLED diode 8, at the photo-inactive transparent portion or portions 9*b*.

Preferably, the rear refracting member 12 is moreover structured so as to cause the light rays $r_b$ to come out from the photo-inactive transparent portion or portions 9*b* of the front face 9 of the OLED diode 8 in a predetermined direction $d_b$ that may be locally perpendicular to the surface of the front face 9, or else may be inclined by a given angle with respect to the perpendicular to the surface of the front face 9.

In addition, the exit direction $d_b$ of the light rays $r_b$ from the front face 9 may be parallel or inclined with respect to the exit direction $d_a$ of the light rays $r_b$ from the front face 9 itself.

In other words, the light rays $r_b$ coming out from the photo-inactive transparent portion or portions 9*b* of the front face 9 of the plate-like OLED diode 8 may be parallel to the light rays $r_a$ coming out from the photo-emitting portion or portions 9*a* of the front face 9 of the OLED diode 8, or else may be inclined by a given angle with respect to the light rays $r_a$ coming out from the photo-emitting portion or portions 9*a* of the front face 9.

Preferably, the rear refracting member 12 is moreover structured to collimate the light rays $r_b$ coming out from the photo-inactive transparent portion or portions 9*b* of the front face 9 of the OLED diode 8 in one and the same direction $d_b$.

In other words, the light rays $r_b$ coming out from the photo-inactive transparent portion or portions 9*b* of the front face 9 are preferably parallel to one another.

With reference to FIGS. 1, 2 and 3, in the example shown, in particular, the plate-like OLED diode 8 is substantially circular in shape, and has a single transparent sector 11 which is preferably, but not necessarily, circular in shape, and is preferably placed substantially at the centre of the body of the plate-like OLED diode 8.

The front face 9 of OLED diode 8 is therefore provided with a preferably, though not necessarily, circular-shaped, photo-inactive portion 9*b* which is preferably located substantially at the centre of the front face 9, and with a large, annular-shaped, photo-emitting portion 9*a* that completely surrounds the photo-inactive portion 9*b*.

Similarly, the rear face 10 of OLED diode 8 is provided with a photo-inactive portion 10*b*, which preferably copies the shape of the photo-inactive portion 9*b* of front face 9, and with a large, annular-shaped, photo-emitting portion 10*a* that completely surrounds the photo-inactive portion 10*b*.

With reference to FIGS. 3 and 4, preferably the rear refracting member 12 comprises, instead, a light-guide body 13 made of photoconductive material, which is arranged directly facing the rear face 10 of OLED diode 8, preferably substantially throughout the whole extension of the same rear face 10, and is structured to collect the light rays $r_b$ coming out from the rear face 10 of the OLED diode 8, or rather from the photo-emitting portions 10*b* of the rear face 10, and then re-direct the light rays $r_b$ towards the photo-inactive transparent portion or portions 10*b* of the rear face 10, with a direction and an angle of incidence that allow the light rays $r_b$ to pass through the OLED diode 8 and then to freely come out from the front face 9 of the OLED diode 8, at the photo-inactive transparent portion or portions 9*b*.

More in detail, the light-guide body 13 is preferably arranged in abutment/resting on the rear face 10 of the plate-like OLED diode 8 preferably so as to cover the entire rear face 10.

With reference to FIGS. 3 and 4, in the example shown, in particular, the rear refracting member 12 preferably comprises a substantially plate-like light-guide body 13, which has the front face 14 and the rear face 15 shaped so as to guide the light rays $r_b$ coming out from the rear face 10 of the OLED diode 8 and entering into the light-guide body 13 along an internal optical path that terminates at the photo-inactive transparent portion or portions 10*b* of the rear face 10 of the OLED diode 8.

More in detail, the plate-like light-guide body 13 preferably has a shape that substantially copies that of the plate-like OLED diode 8, and has the front face 14 and/or the rear face 15 shaped so as to refract the light rays $r_b$ entering into the light-guide body 13 through the front face 14 towards the photo-inactive transparent portion or portions 10*b* of the rear face 10 of the OLED diode 8, with a direction and an angle of incidence such as to cause the light rays $r_b$ to re-enter into the OLED diode 8 and then to come out from the photo-inactive transparent portion or portions 9*b* of the front face 9 of the OLED diode 8.

In the example shown, in particular, the light-guide body 13 is preferably substantially disk-shaped and is preferably made of transparent plastic material, such as for example polycarbonate or polymethyl methacrylate (traditionally referred to as Plexiglas), preferably, though not necessarily, via an injection-moulding process.

Preferably, the front face 14 of light-guide body 13 is moreover provided, in the areas directly facing the photo-emitting portions 10*a* of the rear face 10 of the OLED diode 8, with a plenty of extremely small deflecting lenses 16 with a preferably, though not necessarily, cushion-like profile, each of which is shaped to deflect and/or collimate the light rays $r_b$ that traverse the same deflecting lens 16 towards the rear face 15 of the light-guide body 13, in a given direction and with an angle of incidence such as to cause total reflection of the light rays $r_b$ once again towards the front face 14.

Instead, the rear face 15 of light-guide body 13 is preferably provided with a plenty of small deflecting prisms 17 that are appropriately distributed and shaped so as to reflect the light rays $r_b$ towards the areas of the front face 14 of the light-guide body 13 that face the photo-inactive transparent portion or portions 10*b* of the rear face 10 of the OLED diode 8, with an angle of incidence such as to cause the light rays $r_b$ to penetrate into the OLED diode 8 and then cause the light rays $r_b$ to proceed into the body of OLED diode 8 up to the photo-inactive transparent portion or portions 9*b* present on the front face 9 of the OLED diode 8.

Preferably, but not necessarily, the rear face 15 of light-guide body 13 may moreover be metallized or otherwise mirror-finished so as to prevent the light rays $r_b$ that reach the rear face 15 of the light-guide body 13 from coming out from the light-guide body 13 in areas other than the front face 14.

With reference to FIGS. 2 and 3, the rear supporting structure 7 is instead preferably configured to keep the plate-like OLED diode 8 with the front face 9 locally substantially parallel to the inner surface of the front lenticular half-shell 3 so that the light rays $r_a$ emitted by the photo-emitting portion or portions 9*a* of front face 9 of OLED diode 8 can reach the front lenticular half-shell 3 with an angle of incidence preferably near to 90°.

More in detail, in the example shown, the rear supporting structure 7 preferably comprises a ribbon-shaped rod 18 made of opaque plastic material, which cantilevered projects from the covering mask 5, and has its distal end 18*a* shaped substantially like a pan so as to be able to accommodate the entire planar light source 6.

With reference to FIG. 2, the lighting assembly 4 finally also comprises an electronic control board 19, which is electrically connected to the OLED diode 8 and incorporates the electronic circuits for supply and control of the OLED diode 8.

In the example shown, in particular, the control board 19 is preferably located underneath the covering mask 5, close to the rear body 2, and the OLED diode 8 is electrically connected to the control board 19 via electrical leads 20 that extend along the ribbon-shaped rod 18, up to the joining area with the covering mask 5.

In the example shown, moreover, some lighting assemblies 4 share the same electronic control board 19. In other words, the electronic control board 19 simultaneously supplies a plurality of planar light sources 6.

Operation of the automotive light 1 is readily inferable from what has been described above, and does not require any further explanations.

The advantages associated to the particular structure of the lighting assemblies 4 are considerable.

Firstly, the exit of the light from the photo-inactive portion or portions 9*b* of the front face 9 with a direction and/or an intensity different from that of the light comes out from the remaining part of the front face 9 of the OLED diode 8, allows to make new light patterns and light effects, which are particularly elaborate and radically different from those of automotive lights currently available on the market.

The planar light sources 6 of the individual lighting assemblies 4 may moreover be switched on in a sequential way, thus creating dynamic light signals.

Finally, it is clear that modifications and variations may be made to the automotive light 1 described above, without thereby departing from the scope of the present invention.

For example, with reference to FIG. 4, the planar light source 6 may optionally also be equipped with one or more optical lenses 21 that are located on front face 9 of OLED diode 8, each above a respective photo-inactive transparent portion 9*b*, and are structured to deflect and/or collimate the light rays $r_b$ coming out from the corresponding photo-inactive portions 9*b* of front face 9 in a given direction.

Furthermore, in a different not-shown embodiment the rear refracting member 12 may instead comprise an opaque shielding body, which is arranged facing and optionally also grazing/tangent to the rear face 10 of the OLED diode 8, and is structured to directly reflect the light rays $r_b$ coming out from the rear face 10 of the OLED diode 8, or rather from the photo-emitting portions 10*a* of the rear face 10, towards the photo-inactive transparent portion or portions 10*b* of the rear face 10, with an angle of incidence and a direction such as to cause the light rays $r_b$ to re-enter the OLED diode 8 and then cause them to come out from the photo-inactive transparent portion or portions 9*b* of the front face 9 of the OLED diode 8.

More in detail, the opaque shielding body is preferably substantially plate-like, and has the front face, i.e. the face turned towards the OLED diode 8, metallized or otherwise mirror-finished so as to reflect the incident light once again towards the OLED diode 8.

The surface of the front face of the opaque shielding body moreover has a complex three-dimensional profile structured/calculated so as to direct the light rays $r_b$ coming out from the rear face 10 of the OLED diode 8 orthogonally to the surface, towards the photo-inactive transparent portion or portions 10*b* of the rear face 10 of the OLED diode 8, with an angle of incidence and a direction such as to cause the light rays $r_b$ to re-enter the OLED diode 8 through the photo-inactive transparent portion or portions $\mathbf{10}_b$, and then cause them to come out from the photo-inactive transparent portion or portions $\mathbf{9}_b$ of the front face 9 of the OLED diode 8.

Moreover, in a less sophisticated and not-shown embodiment, the plate-like OLED diode 8 may have, instead of the transparent sector or sectors 11, one or more through holes realized within the external perimeter of the OLED diode 8, or else substantially tangent to the external perimeter of the OLED diode 8. The two mouths of the transverse through hole or holes would then form the photo-inactive transparent portions 9*b* and 10*b* of the front face 9 and of the rear face 10 of the OLED diode 8.

Finally, the rear body 2 could be structured so as to be simply cantilever fixed on the rear part of the vehicle body (not shown).

Although the present invention has been described with reference to exemplary embodiments and implementations thereof, the present invention is not limited by or to such exemplary embodiments and/or implementations.

The invention claimed is:

1. An automotive light (1) comprising: a substantially basin-shaped, rear body (2) structured to be fixed on the vehicle body; a front lenticular half-shell (3) which is arranged to close the mouth of the rear body (2) and is provided with at least one transparent or semi-transparent portion; and at least one lighting assembly (4) which emits light on command and is located within the rear body (2) so as to backlight the transparent or semi-transparent portion of the front lenticular half-shell (3);

said at least one lighting assembly (4) in turn comprising an OLED-type planar light source (6) which is capable of emitting light from its own front face and is located within the rear body (2) with the front face turned towards the inner surface of the front lenticular half-shell (3) so as to direct the light produced towards the front lenticular half-shell (3);

said automotive light (1) being characterized in that the OLED-type planar light source (6) comprises: at least one plate-like OLED diode (8) which is capable of emitting light in a distributed manner from its own front face (9) and from its own rear face (10), and has at least one transverse light passageway (11) structured for allowing the light to pass freely through the thickness of the same plate-like OLED diode (8); and a rear refracting member (12), which is arranged facing the rear face (10) of the OLED diode (8) and is able to re-direct the light ($r_b$) coming out from the rear face (10) of the OLED diode (8) towards said transverse light passageway (11) in a direction such that said light ($r_b$) can pass though the OLED diode (8) and then come out from the front face (9) of the OLED diode (8).

2. Automotive light according to claim 1, wherein the front face (9) and the rear face (10) of the OLED diode (8) are both provided with at least one photo-emitting portion (9*a*, 10*a*) and one photo-inactive transparent portion (9*b*, 10*b*) aligned with said at least one transverse light passageway (11); the rear refracting member (12) being structured to divert the light rays ($r_b$) coming out from the rear face (10) of the OLED diode (8) towards the photo-inactive transparent portion or portions (10*b*) of the rear face (10) of the same OLED diode (8), with a direction and an angle of incidence that allows the same light rays ($r_b$) to pass though the OLED diode (8) and then freely come out from the front face (9) of the OLED diode (8), at the corresponding photo-inactive transparent portion or portions (9*b*).

3. Automotive light according to claim 2, wherein the photo-emitting portion or portions (9*a*) of the front face (9) of the OLED diode (8) are able to emit light rays ($r_a$) in a first predetermined direction ($d_a$), and in that the rear refracting member (12) is structured to cause the light rays ($r_b$) to come out from the photo-inactive transparent portion or portions (9*b*) of the front face (9) of the OLED diode (8) in a second predetermined direction ($d_b$).

4. Automotive light according to claim 3, wherein said second direction ($d_b$) is inclined with respect to said first direction ($d_a$).

5. Automotive light according to claim 2, wherein said first direction ($d_a$) is locally substantially perpendicular to the surface of the front face (9) of the OLED diode (8).

6. Automotive light according to claim 1, wherein the rear refracting member (12) is able to collimate the light rays ($r_b$) coming out from the photo-inactive transparent portion (9*b*) of the front face (9) of the OLED diode (8) in one and the same direction ($d_b$).

7. Automotive light according to claim 1, wherein the plate-like OLED diode (8) is substantially circular in shape.

8. Automotive light according to claim 1, wherein said at least one transverse light passageway (11) is located within the perimeter of the plate-like OLED diode (8).

9. Automotive light according to claim 1, wherein the rear refracting member (12) comprises a light-guide body (13) made of photoconductive material, which is arranged facing the rear face (10) of the OLED diode (8) and is structured to collect the light rays ($r_b$) coming out from the photo-emitting portion or portions (10*b*) of the rear face (10), and then re-direct the same light rays ($r_b$) towards the photo-inactive transparent portion or portions (10*b*) of the rear face (10), with an angle of incidence that allows the light rays ($r_b$) to pass though the OLED diode (8) and then freely come out from the front face (9) of the OLED diode (8), at the photo-inactive transparent portion or portions (9*b*).

10. Automotive light according to claim 9, wherein the light-guide body (13) is arranged in abutment/resting on the rear face (10) of the plate-like OLED diode (8).

11. Automotive light according to claim 9, wherein the light-guide body (13) is substantially plate-like and has its front face (14) and rear face (15) shaped so as to guide the light rays ($r_b$) that come out from the rear face (10) of the OLED diode (8) and enter into the light-guide body (13), along an internal optical path that terminates at the photo-inactive transparent portion or portions (10*b*) of the rear face (10) of the OLED diode (8).

12. Automotive light according to claim 11, wherein the plate-like light-guide body (13) has a shape that substantially copies that of the plate-like OLED diode (8).

13. Automotive light according to claim 1, wherein the rear refracting member (12) comprises an opaque shielding body which is arranged facing the rear face (10) of the OLED (8), and is structured to directly reflect the light rays ($r_b$) coming out from the rear face (10) of the OLED diode (8) towards the photo-inactive transparent portion or portions (10*b*) of the same rear face (10), with an angle of incidence and a direction such as to cause said light rays ($r_b$) to re-enter the OLED diode (8) and then to come out from the photo-inactive transparent portion or portions (9*b*) of the front face (9) of the OLED diode (8).

14. Automotive light according to claim 1, wherein said at least one lighting assembly (4) additionally comprises a supporting structure (7) which is located/fixed within the body (2) and is configured to support the planar light source (6).

15. Automotive light according to claim 14, wherein the supporting structure (7) is able to keep the OLED diode (8) with the front face (9) locally substantially parallel to the inner surface of the front lenticular half-shell (3).

* * * * *